United States Patent [19]

Kouroupis et al.

[11] Patent Number: 4,593,626

[45] Date of Patent: Jun. 10, 1986

[54] TEMPERATURE CONTROLLED ADJUSTING MECHANISM

[75] Inventors: John Kouroupis, Baltimore; John J. Chino, Arnold, both of Md.

[73] Assignee: The United States of America as represented by the Secretary of the Army, Washington, D.C.

[21] Appl. No.: 623,883

[22] Filed: Jun. 25, 1984

[51] Int. Cl.[4] ..... A47B 9/00

[52] U.S. Cl. ..... 108/4; 33/568; 108/144; 248/188.2; 269/55

[58] Field of Search ..... 108/1, 4, 20, 144; 33/567, 568, 573; 248/188.2, 637; 251/11; 269/55; 350/529, 533

[56] References Cited

U.S. PATENT DOCUMENTS 3,500,634 3/1970 Waseleski, Jr. et al. ..... 251/111 X 4,374,497 2/1983 Harmand ..... 108/4

*Primary Examiner*—William E. Lyddane

*Assistant Examiner*—Peter R. Brown

*Attorney, Agent, or Firm*—Anthony T. Lane; Robert P. Gibson; Harold W. Hilton

[57] ABSTRACT

A mechanism for providing precise (microradians) angular adjustment for high resolution adjustable mounts and platforms used to design optical elements. The mechanism includes temperature-controlled rods having internally embedded heater elements and thermistors attached to a stable platform. The heaters and thermistors are attached to a proportional control circuit which accurately and precisely regulates rod temperatures.

2 Claims, 4 Drawing Figures

TEMPERATURE CONTROLLED ADJUSTING MECHANISM

DEDICATORY CLAUSE

The invention described herein was made in the course of or under a contract or subcontract thereunder with the Government and may be manufactured, used, and licensed by or for the Government for governmental purposes without the payment to us of any royalties thereon.

BACKGROUND OF THE INVENTION

The trend towards more sophisticated militarized optical systems has placed a heavy burden on the design of high resolution rugged optical adjustment mechanisms. A typical laser system with two or more optical elements must be precisely aligned for efficient operation. Alignment of these elements must be maintained over a wide range of temperature, shock and vibration disturbances.

High resolution adjustable mounts used to align optical elements, incorporate either differential screws, sliding wedges or similar mechanisms. These mechanisms must provide movement of a few millionths of an inch or a few microradians to align optical components. In a typical application where an optical system would be subjected to shock and vibration disturbances, designing a mechanism with screws or wedges that has adequate stiffness is difficult and complex. A stiff mount is required to minimize angular and linear motion of supported optics.

Load paths through either screw or wedge adjustments will not provide adequate stiffness. The result is an optical system sensitive to vibration distrubances. Another problem which plagues screw or wedge mechanisms are their ability to recover after a shock load. Again, in the microradian range, minute relative motion between screw threads or other mated surfaces will result in alignment errors. To prevent this motion adds to the cost and complexity of the mechanism.

Finding an adequate method of locking the mechanism, once alignment has been achieved, is also difficult. Locking screws, nut cleats, or other devices will result in undesirable movement which must be corrected. When preload springs are used to prevent relative movement, stiffness is compromised. A stiff, simple, high resolution adjustment mechanism is needed to eliminate many of the problems associated with complex mechanisms.

This disclosure describes the application of a simple property of most materials; that is, a change in temperature will result in a change in length. If a rod, with adequate stiffness had a controlled heater embedded in the center, the rod length could be controlled by controlling the rod temperature.

SUMMARY OF THE INVENTION

A mechanism that allows a stable platform to possess two degrees of angular freedom. The mechanism includes three short rods attached to the platform adjacent three of the corners of the platform. Two of the rods have internally embedded heater elements and thermistors therein for precise temperature control. The third rod, made of a material possessing a very low coefficient of thermal expansion, is not temperature controlled.

DESCRIPTION OF THE PREFERRED EMBODIMENT

Figure 2:
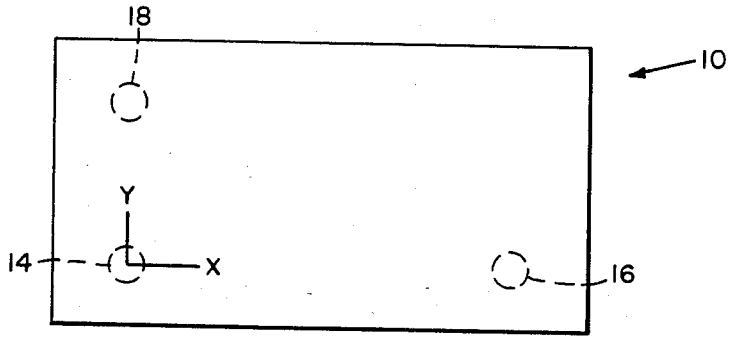
FIG. 2 is a view along line 2—2 of FIG. 1.
Figure 1:
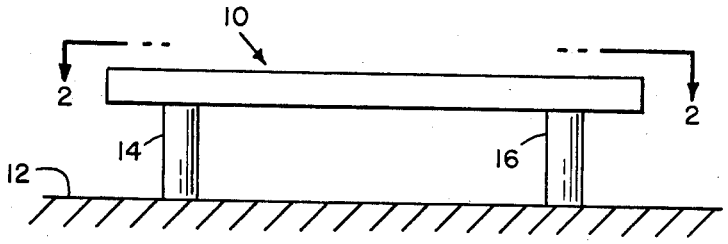
FIG. 1 is an elevational view of a stable platform utilizing the principles of the present invention.

As seen in FIG. 1, a stable platform 10 is supported on a fixed reference 12 by support members or rods 14 and 16. A third support member or rod 18 is shown in FIG. 2. Rods 16 and 18 are temperature controlled while rod 14 is a thermally stable rod.

Figure 4:
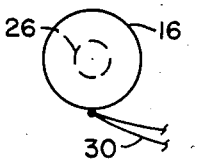
FIG. 4 is a view along line 4—4 of FIG. 3.
Figure 3:
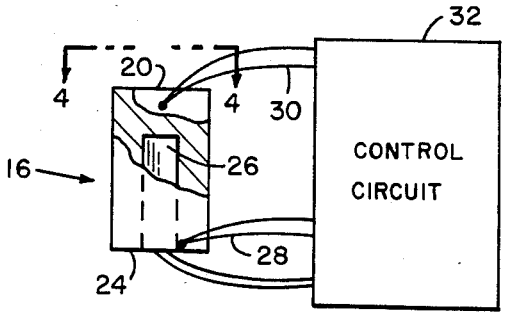
FIG. 3 is an elevational view of a rod for support of the platform having a heating element and thermistors embedded therein.

Rods 16 and 18 are identical and are illustrated in FIGS. 3 and 4. These rods are provided with a high thermal impedance interface at ends 20 and 24 thereof. A heater element 26 and a pair of thermistors 28 and 30 are embedded in the rods. These heaters and thermistors are attached to a proportional control circuit 32 which accurately ($\pm 1°$ F.) regulates the rod temperatures. As the rods are heated, they expand in length; relieving the heat source reduces the temperatures of the rods, which results in a contraction. Since the temperature controlled rods are diagonally opposite each other, differences in control temperatures result in an angular displacement of the entire platform. The third rod 14 is not temperature controlled and is made of a material, such as Invar, possessing a very low coefficient of thermal expansion. Hence, this third rod will remain stable regardless of ambient temperature fluctuations. In addition, this third rod provides the final component for the classical three point mount.

The two control temperature setpoints must be above the maximum expected ambient temperature so as to eliminate the effect of the environment on the orientation of the platform. Classical proportional control circuitry can hold the temperature setpoint to $\pm 1°$ F., therefore, there will be high resolution or in essence, minimum angular motion once the proper setpoint is reached.

Referring to FIG. 2, angular adjustment about the Y-axis is achieved through varying the temperature of rod 16 while maintaining rod 18 at the initial temperature controlled setpoint (initially, rods 16 and 18 are controlled at this same setpoint, and rod 14 is comprised of the thermally stable material). Increasing the heater power to rod 16 will increase its temperature and cause angular motion in one direction while reducing the heater power to this rod will reduce its temperature and cause angular motion in the other direction. Similarly, angular adjustment about the X-axis is acheived through varying the temperature of rod 18 while maintaining rod 16 at a constant temperature.

The sample calculation below indicates the angular motion achievable with this concept. A 10"×10" stable optical platform is considered as are 1½" long Magnesium rods. Magnesium is used here due to it possessing a relatively high coefficient of thermal expansion-approximately $22\times10^{-6}$ in/in°F. (compared to about $13\times10^{-6}$ in/in°F. for aluminum, $10\times10^{-6}$ in/in°F. for steel and $0.18\times10^{-6}$ in/in°F. for Invar).

In one particular application of the present device, a laser weapon system, the system has a maximum anticipated ambient temperature of about 120° F., therefore, if one were considering this system, both rods 16 and 18 will be considered to be initially controlled to 160° F.±1° F.

For illustrative purposes, motion about the Y-axis direction will be considered and rod 16 will be increased in temperature to 220° F. while rod 18 is maintained at 160° F.±1° F.

$\Delta L = \alpha L \Delta T$ $\Delta L = (22 \times 10^{-6}$ in/in°F.) (1.5 in) (220° F.−160° F.)=0.002 in. where $\alpha$ is the coefficient of thermal expansion, L is the rod length and $\alpha T$ is the temperatures of the rods.

The resulting angular motion achieved can then be calculated:

$$\text{Sin}\theta = \frac{0.002''}{10''} \rightarrow \theta = 0.011° = 200 \text{ microradians.}$$

It is to be understood that the proportional control circuit 32 is well known in the art and will maintain the optical system in alignment for a predetermined length of time. It is seen from the above analysis that for a 200 microradian angular motion a 0.002 inch change in rod length is required. Therefore, with predetermined temperature values applied to the control circuit the circuit may energize the desired rod or rods to a predetermined temperature value for the desired rod or rods expansion. Thereafter, the control circuit will be referenced to the rod temperature values and will maintain the temperature at these values by sensing the temperature through the thermistors and controlling the temperature of the rods.

Obviously, this device has general potential application. Accordingly, the angular motion shown above is a function of the initial length of the rod, the rod material and the imposed temperature differential. Since the rods are controlled to a temperature higher than the maximum anticipated ambient temperature, the heaters will always control the rods to the selected temperatures. As the ambient temperature varies, the sole effect will be the amount of heater power required to maintain the setpoint temperatures.

The novelty of this disclosure resides in the utilization of a fundamental physical relationship ($\Delta L = \alpha L \Delta T$) for providing small controlled motions of a stable platform. This disclosure describes the application of the mechanism to supply two degrees of freedom; however, this mechanism is not limited in the amount of degrees of freedom it can provide. Through the proper selection of the number of rods and in their location, this mechanism technique can provide any number of degrees of freedom desired. The magnitude of these degrees of freedom (microradians) makes it particularly advantageous to systems requiring precision alignments; for example, optical type applications.

In addition, this device simultaneously provides a relatively simple and stiff mechanism with high resolution and without the problems associated with conventional adjustment mechanisms, such as backlash.

We claim:

1. Mechanism for providing two degrees of angular freedom to a high resolution adjustable platform to permit precise angular adjustment thereof comprising:

a. a platform;

b. three rod members disposed for support of said platform on a surface providing a fixed reference;

c. temperature control means carried in a pair of said rod members, said temperature control means disposed for selectively controlling the temperature of said pair of rods to provide for expansion or contraction thereof, the third of said three rods being thermally stable, each of said rods being positioned adjacent to corners of said platform and said temperature controlled rods being diagonally spaced whereby selected temperature variations causes expansion and contraction of the pair of rod members thereby causing precise angular adjustment of the platform.

2. Mechanism as in claim 1 wherein said temperature control means are heater elements in said pair of said rod members and thermistor means embedded in said pair of said rods, said heater elements and said thermistor means adapted for connection to a control circuit.

* * * * *